US007156068B2

(12) United States Patent
Yüksel

(10) Patent No.: US 7,156,068 B2
(45) Date of Patent: Jan. 2, 2007

(54) ROTARY COMBUSTION ENGINE

(76) Inventor: Galip Yüksel, Im Lontel 21, 71254 Ditzingen (DE)

( * ) Notice: Subject to any disclaimer, the term of this patent is extended or adjusted under 35 U.S.C. 154(b) by 0 days.

(21) Appl. No.: 10/514,147

(22) PCT Filed: May 15, 2003

(86) PCT No.: PCT/DE03/01691

§ 371 (c)(1),
(2), (4) Date: May 6, 2005

(87) PCT Pub. No.: WO03/098004

PCT Pub. Date: Nov. 27, 2003

(65) Prior Publication Data

US 2005/0247282 A1 Nov. 10, 2005

(30) Foreign Application Priority Data

May 15, 2002 (DE) ..... 102 23 145

(51) Int. Cl.

| | |
|---|---|
| ***F02B 53/00*** | (2006.01) |
| ***F02B 53/04*** | (2006.01) |
| ***F01C 1/00*** | (2006.01) |
| *F04C 18/00* | (2006.01) |
| *F04C 2/00* | (2006.01) |

(52) U.S. Cl. ..... 123/245; 123/234; 418/34; 418/35; 418/36

(58) Field of Classification Search ..... 123/245, 123/234; 418/34–38
See application file for complete search history.

(56) References Cited

U.S. PATENT DOCUMENTS

| | | | | |
|---|---|---|---|---|
| 1,367,591 A | | 2/1921 | Duncombe | 123/245 |
| 1,946,136 A | * | 2/1934 | Farley | 418/36 |
| 3,312,200 A | | 4/1967 | Benson | 123/234 |
| 4,281,628 A | | 8/1981 | Doundoulakis | 123/245 |
| 4,390,327 A | * | 6/1983 | Picavet | 418/35 |
| 5,083,540 A | * | 1/1992 | Smith | 123/234 |
| 5,501,070 A | * | 3/1996 | Lin | 418/34 |

FOREIGN PATENT DOCUMENTS

| | | | | |
|---|---|---|---|---|
| AT | 3654 | | 3/2001 | |
| DE | 826 378 | | 1/1952 | |
| DE | 41 19 312 | A1 | 12/1992 | |
| DE | 197 11 972 | A1 | 9/1998 | |
| FR | 804079 | | 10/1936 | |
| JP | 01310102 | A * | 12/1989 | 418/36 |

* cited by examiner

*Primary Examiner*—Thai-Ba Trieu
(74) *Attorney, Agent, or Firm*—Walter A. Hackler

(57) ABSTRACT

The aim of the invention is to dispense with the disadvantages of previous engines either fully or partially. This is achieved by two cylindrical parts which rotate into each other, respectively possessing a wing and which can rotate about an axis of different speeds. Similar to a four-stroke engine, the following occurs: induction of an air-fuel mixture, compression until self-ignition, creation of a working stroke and discharge of combustion gases. The variable inlet and outlet opening times are controlled according to a control bushing and a special stepper motor. The rotating wings are controlled by freewheeling and by unilaterally acting hydrodynamic brakes or secured against reversed rotation. In relation to the cylinder core, two functional variable work chambers arise for each disk discharge elements, which were not possible with the previously rigid engine structure.

12 Claims, 17 Drawing Sheets

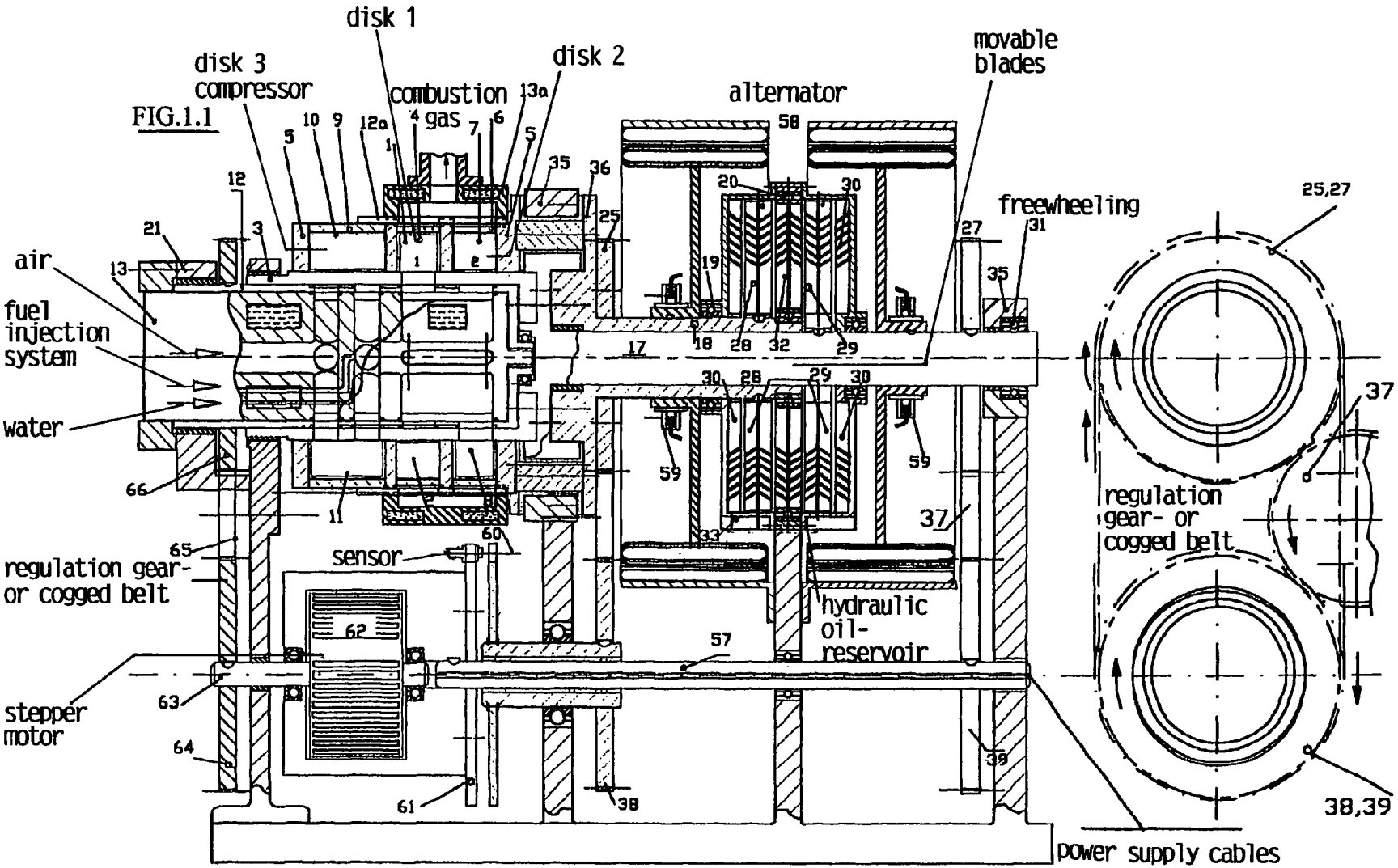
FIG.1.1

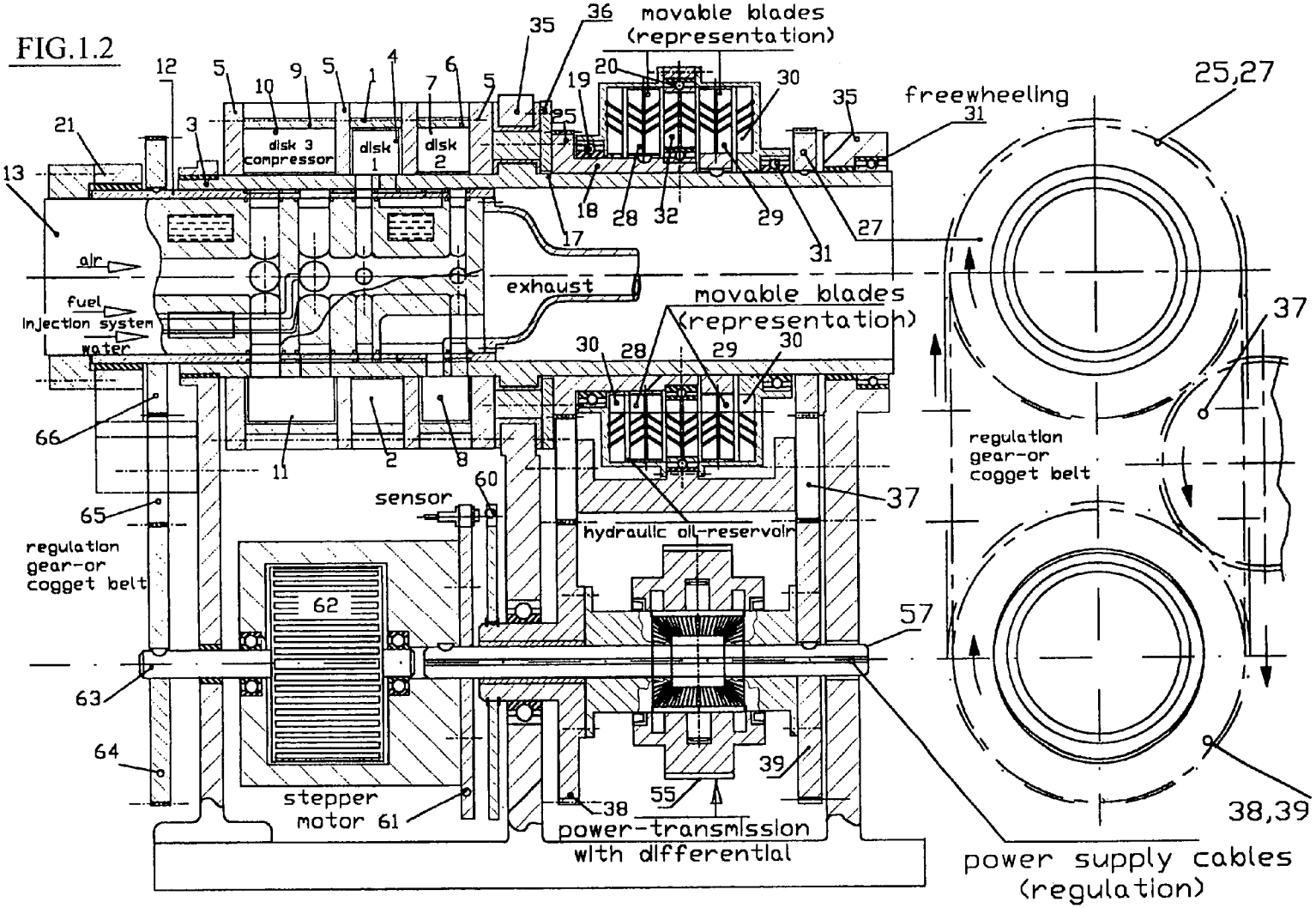
FIG.1.2

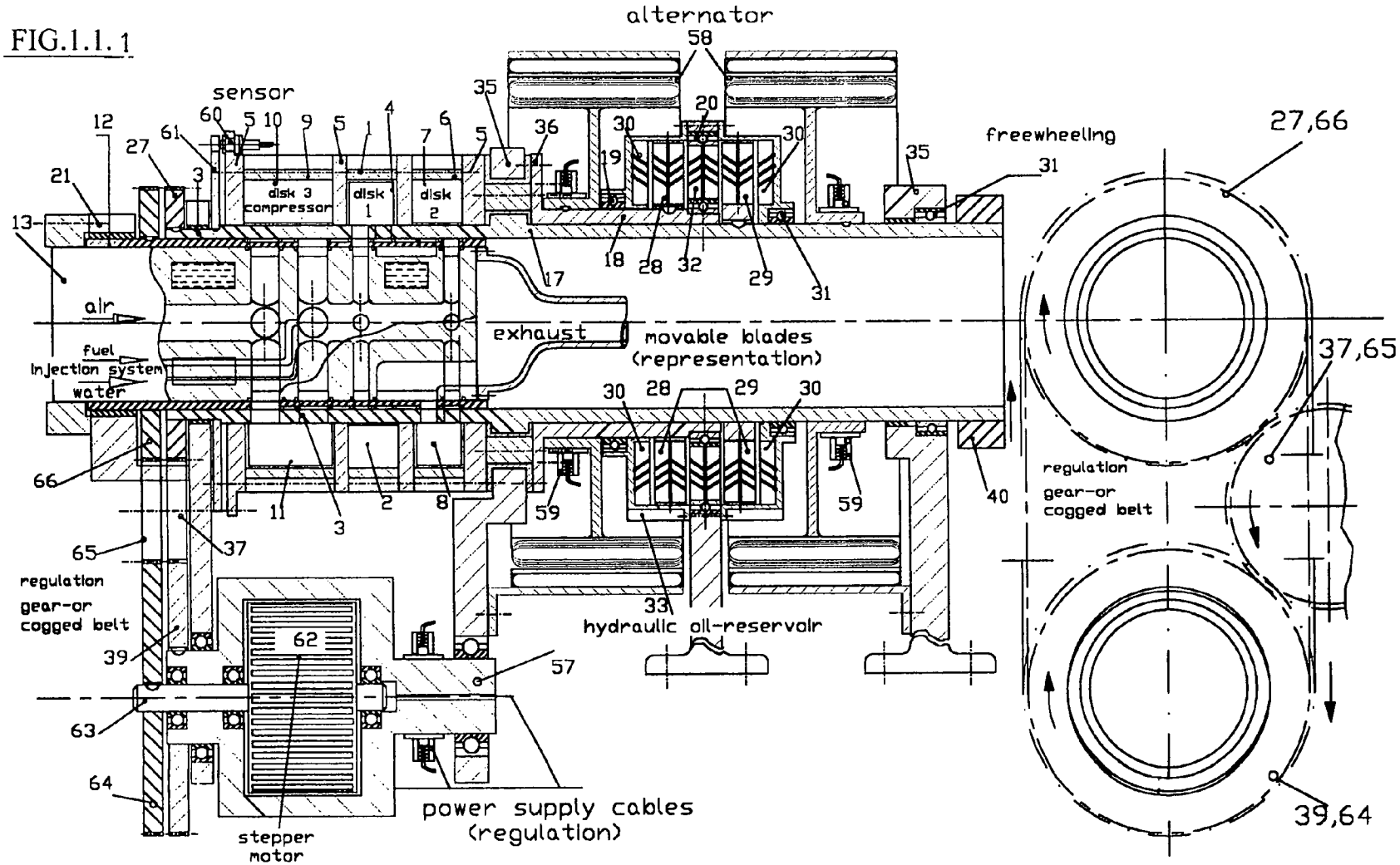
FIG.1.1.1 part section view of Fig.1

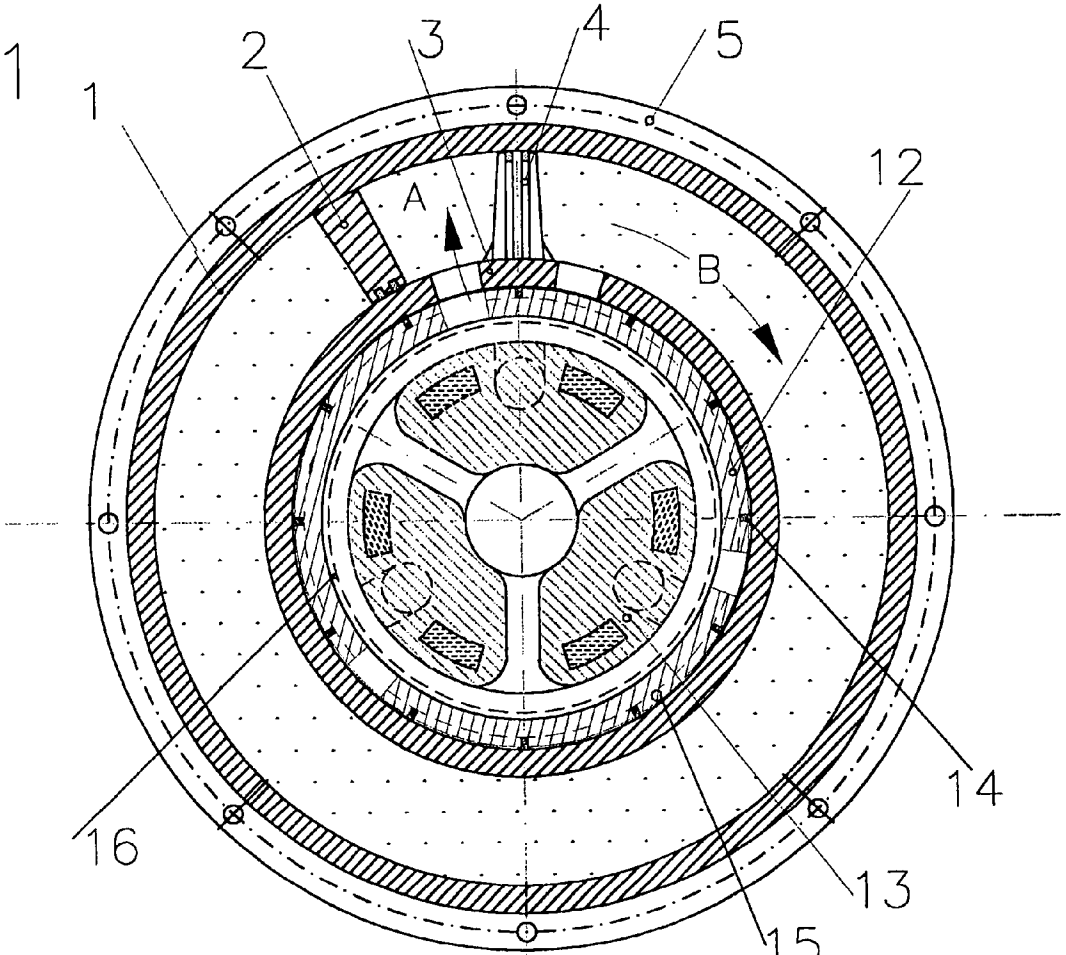
FIG. 2.1
SECTION A–A
INDUCTION– CHANNEL LEVEL

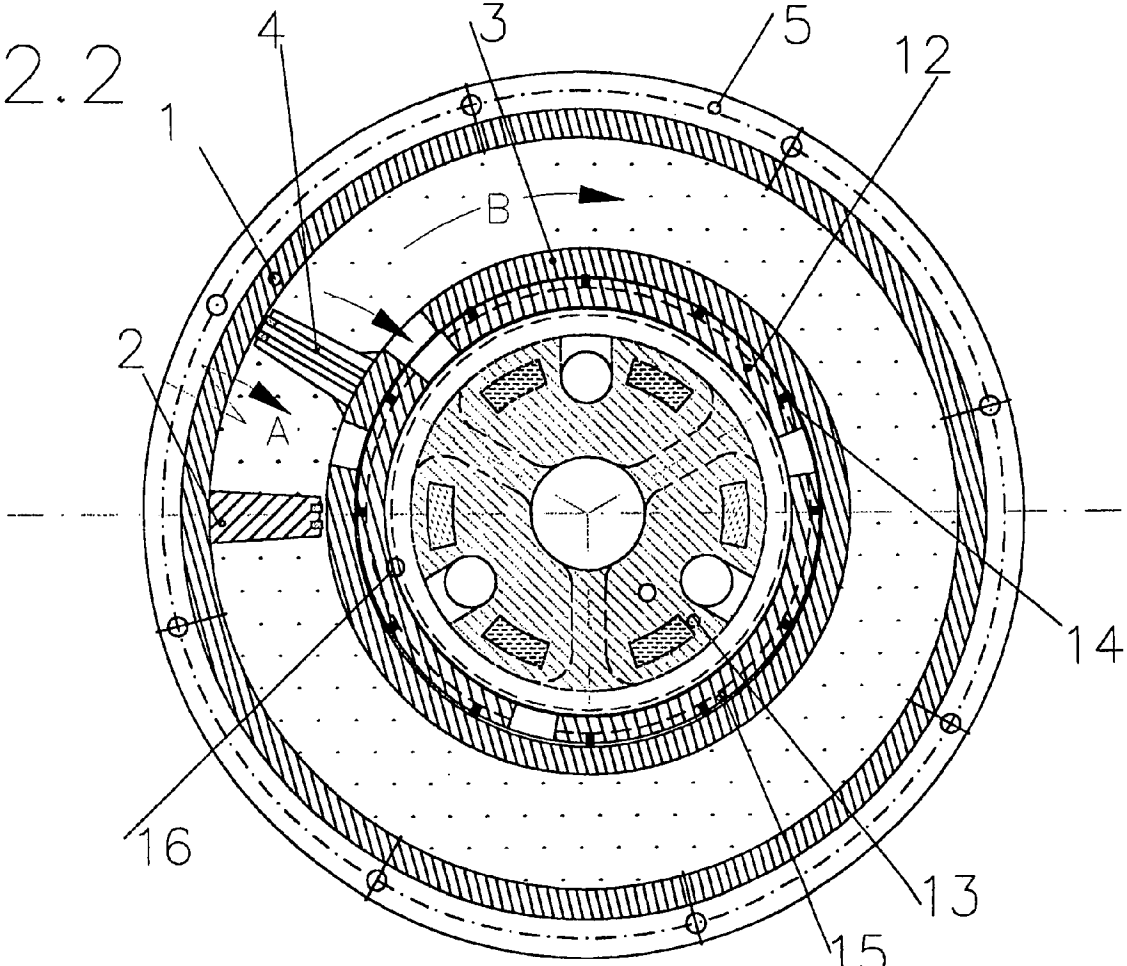
FIG. 2.2
SECTION B–B
EXHAUST– CHANNEL LEVEL

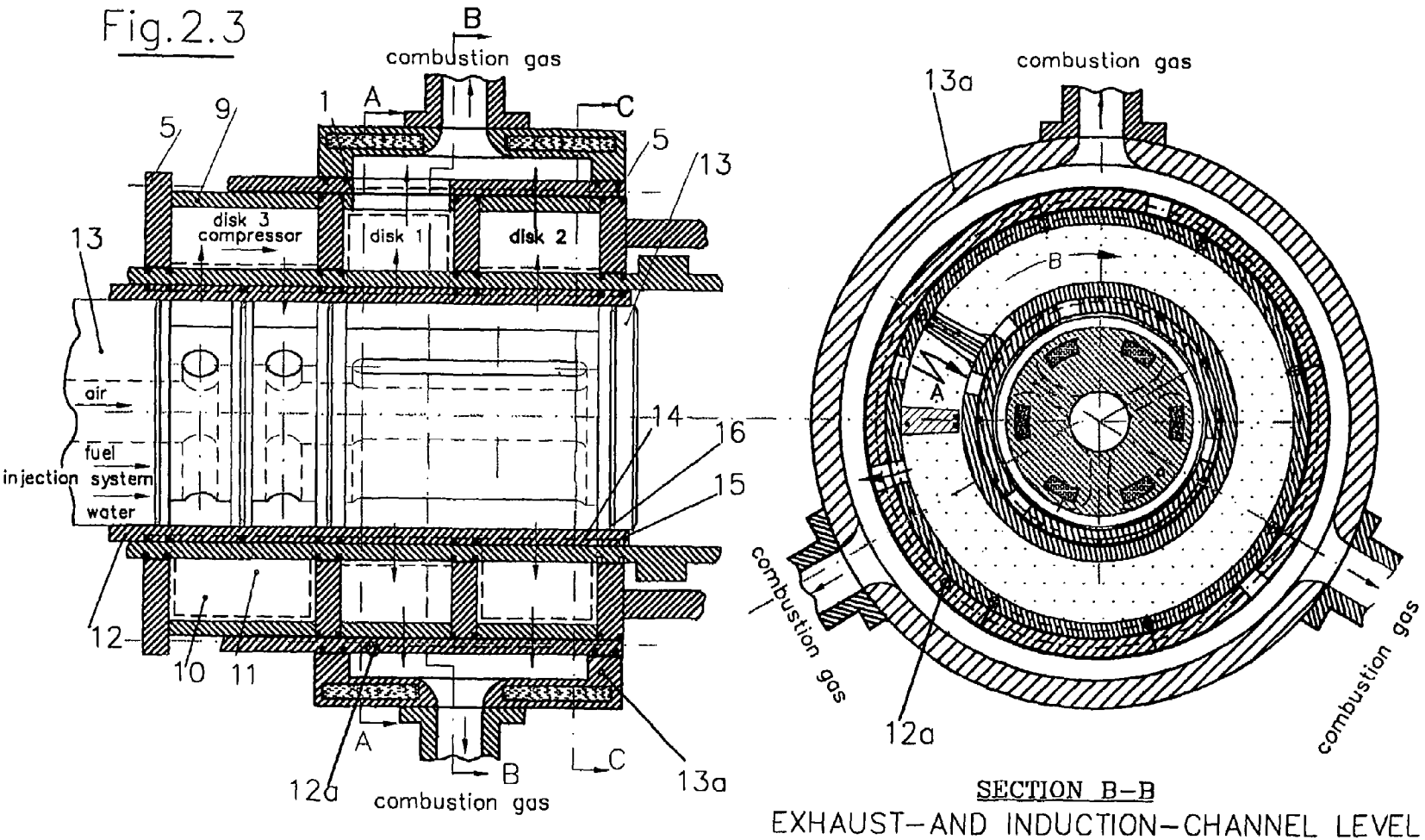
Fig. 2.3

DISK 1

SECTION A–A
INDUCTION CHANNEL LEVEL

SECTION B–B
EXHAUST CHANNEL LEVEL start of stroke
induction/compression
A B start of stroke
compression/working
A B start of stroke
working/combustion
A B start of stroke
combustion/induction
A B

DISK 2

SECTION C–C
EXHAUST CHANNEL LEVEL

SECTION D–D
INDUCTION CHANNEL LEVEL start of stroke
working/combustion
C D start of stroke
combustion/induction
C D start of stroke
induction/compression
C D start of stroke
compression/working
C D

ROTARY COMBUSTION ENGINE

1. TECHNICAL TERM

Rotary combustion engine

2. Field of Application

The invention is an axial combustion engine, which can generally be used as drive engine. Optionally, after some tiny modifications, which do not affect the main principles, this engine can also be used as a steam engine, compressor or pump.

3. Purpose

This new kind of combustion engine is supposed to provide an alternative to the combustion engine, which is presently prominent on the market.

4. The Status quo of Technical Inventions and Criticism

At the current status of technical invention, there are mainly two types of combustion engine available: First, the internal 2- and 4-cycled internal combustion piston engine, which is also called the Otto-engine, secondly, the rotary engine, which is also referred to as Wankel-type engine. The Otto-engine is regularly used by means of gasoline and diesel fuel and is predominantly applied in the automobile sector.

Disadvantages of the 2-Cycle Otto-engine:

- Higher fuel consumption up to approximately half load and especially at full load because of scavenging and charging loses at carburetor system.
- Higher heat loading because of a failure in the backlash (lost motion) and because of difficult heat dissipation.
- Poorer torque at low RPM.
- Intermittent engine operation at idle range.
- Mostly imperfect mass balance
- Very noisy operation
- Its vehicle exhaust emissions are bad for the environment (gasoline-oil mixture).
- Low power efficiency because of cooling.
- Functions only with ignition.

Disadvantages of the 4-Cycle Otto-Engine:

- The power unit can only be only used 50%, as for one working cycle two crankshaft revolutions are necessary
- Low rate of uniformity (low engine smoothness)
- The mechanic efficiency is reduced because of the two strokes which are lost motion and because of the valve operation.
- Low power efficiency because of cooling.
- Functions exclusively with ignition.

Disadvantages of the Diesel Engine:

- Bad combustion process because the fuel can only be injected when, as a precondition the air is compressed up to 30–50*bar at a temperature of 700°–900° Celsius. The early ignition causes knocking.
- Late injection causes uncomplete combustion.
- For cold starting, glow plugs are necessary.
- The ignition pumps make too much noise.
- Low efficiency because of cooling.

Disadvantages of the Wankel-Engine:

- Deficiencies at the sealing of the rotary engine combustion chamber, causing problems.
- Irregular operation because of the non-centric operation of the rotary engine.
- Torque characteristics are poor.
- Engine efficiency is not satisfactory.
- Poor combustion (bad exhaust emissions).
- High manufacturing costs.
- Low power efficiency because of cooling.
- Works only with ignition.

Source/bibliography: partly from the automotive (engineering) paperback of the Robert Bosch company.

5. Objective

The object of this invention is to partly or even fully eliminate the disadvantages of the currently prevalent engines and thus to obtain a more economic engine. The design also offers an adequate premise for the application of highly developed new materials, such as, for instance, ceramics. As a result, friction and cooling can be reduced to a minimum, and a higher operating temperatures can be reached. With additional water injection, also better fuel economy is possible.

6. Sojution

According to the invention described in FIGS. 1 to 13, this object is achieved by means of two cylindrical parts which rotate in each other, and which can rotate about one axis at different speeds, and which each possess a blade. Because of the different rotational speeds two functional working chambers, which are very similar to the four-stroke engine, are created per disk (see the design in FIGS. 2.1 and 2.2, parts 1 to 5). The resulting working chambers can occur at any place of the cylinder circumference (at variable combustion ratios and at variable stroke lengths).

To permit smooth running, two chambers, here called disks, are arranged, in fact in a very similar way to the Wankel-engine, but arranged with an angle of 180° between the two chambers. With an adequate angle division more than two disks are technically possible. Control is effected by means of a stepper motor, which is connected to the inner cylinder hollow shaft and to the pulse generator disk which is again connected to the outer cylinder shaft.

A comparable engine is known from U.S. Pat. No. 1,367,591, which has partly other functions. There one working chamber per disk is created through mechanical fixing of the corresponding blade, and from the limited move of the other blade an angle of 180°, (one half revolution of the shaft) results. With that rigid design the compression ratio is not sufficient. According to the schematic figure the intake cycle is not functionally efficient. Only low output can be expected because of the air resistance (compression or vacuum) between the blades in the second chamber.

This is proofed by the fact that such an engine has so far found no application in the technical field.

An example of the invention is shown in FIGS. 1–13 and described in the following:

FIG. 1 shows a rotary combustion engine in longitudinal cutaway view, consisting of three disks, each with one exterior-cylinder and a blade and a common interior-cylinder with one blade per disk.

Disk 3 functions as compressor and also as starting aid for the engine. Disks 1 and 2 serve as working cylinders of the engine.

This rotary combustion engine additionally contains a control bushing with moving parts, which rotate axially around a static cylinder core with intake and an exhaust channels and a retaining system against reversed rotation, power transmission elements and a special (revolving) stepper motor (62) as control system.

FIG. 2 shows an exploded diagram analogous to FIG. 1 and FIG. 1.1 with sectional views A to D but without the control elements, the retaining system securing against reversed rotation and the power transmission elements.

FIGS. 2.1 and 2.2 show a sectional view through disk 1 of the engine with two working chambers, consisting of exterior-cylinder with blade, interior-cylinder with blade, control bushing with sealing strips or radial seal rings and the static cylinder core with the corresponding seals.

FIG. 3-3*a* show the start of induction stroke in working-chamber "A", compression in chamber "B"

FIG. 4-4*a* show the start of compression stroke in working-chamber "A", working in chamber "B"

FIG. 5-5*a* show the start of working stroke in working-chamber "A", combustion in chamber "B"

FIG. 6-6*a* show the start of combustion stroke in working-chamber "A", induction in chamber "B"

In disk 2, shown in FIG. 7-10 and in FIG. 7*a*-10*a* (section C—C and section D—D) with working chambers "C" and "D", the same working cycles take place as in disk 1, but rotated by an angle of 180 degrees, so that for every full rotation of the blade all four strokes take place in the working chambers (A"–"D").

This is explained with the following examples:

| Working-chamber A | Working-chamber B | Working-chamber C | Working-chamber D |
|---|---|---|---|
| FIG. 3: Induction | 3a: Compression | 7: Working | 7a: Combustion |
| FIG. 4: Compression | 4a: Working | 8: Combustion | 8a: Induction |
| FIG. 5: Working | 5a: Combustion | 9: Induction | 9a: Compression |
| FIG. 6: Combustion | 6a: Induction | 10: Compression | 10a: Working |

The A—A sectional view according to FIG. 2.1 shows the intake channel level of disk 1 and the section B—B according to FIG. 2.2 shows the exhaust channel level of disk 1.

FIG. 2*a* shows the three-dimensional-perspective drawings of FIG. 2, but without the control bushing and without the cylinder core.

FIG. 2*b* shows the three-dimensional-perspective drawing of the control bushing with intake and exhaust openings as well as grooves for the sealing strips and radial seal rings and the interior-cylinder.

In this example the circumference of the control bushing is divided into 12 segments, each of 30° and has an opening in every forth segment on disk 1 and 2. This 30° division must be identical with the openings of the interior-cylinder.

A spacing with another suitable number of openings and angles is possible, as well.

The exhaust openings are offset by one segment (here 30°) against the rotary direction, because the stepper motor sets the control bushing back by 30° against the rotary direction. The same is possible in the rotary direction, but this is not advantageous.

In disk 2 the openings are arranged similar to those of disk 1 but offset by 180° so that for every rotation (cycle) all 4 strokes take place.

In disk 3, which is used as a compressor, the openings are spaced at 60°, that is in every second segment, and the intake and the exhaust openings are located offset by 30°.

FIG. 3-10*a* show the different positions giving an overall view of the functioning of the engine shown in FIG. 1-2.2.

FIG. 3-6*a* show disk 1

FIG. 7-10*a* show disk 2, but rotated by 180 degrees.

First FIG. 3-6*a* shall be described.

Here two working chambers are created in disk 1; these are referred to as working chamber "A" and as working chamber "B".

FIG. 3-6 (section A—A) shows the working cycles of working chambers "A" and "B" at the inlet channel level. In FIG. 3*a*-6*a* (section B—B) the working cycles of working chambers "A" and "B" at the exhaust channel level are shown.

This is achieved through the control elements, which control the intake and the exhaust channel (in the example with an angle of 30°) in such a manner that in every working-chamber "A"–"D" all four working cycles can take place.

Also at the transmission hollow shafts 17/18, blades are fixed with movable blades. The wheel blades run in a fluid (oil), similar to an automatic gearbox or hydrodynamic brakes.

When the wheel blade rotates forward in the fluid, the blades fold shut and pose no resistance. At the same time the blades of the other blade wheel open in the oil and slow down that wheel, and even further accelerate the opposite wheel.

That process is, in turn, repeated during every working stroke.

Figure 13:
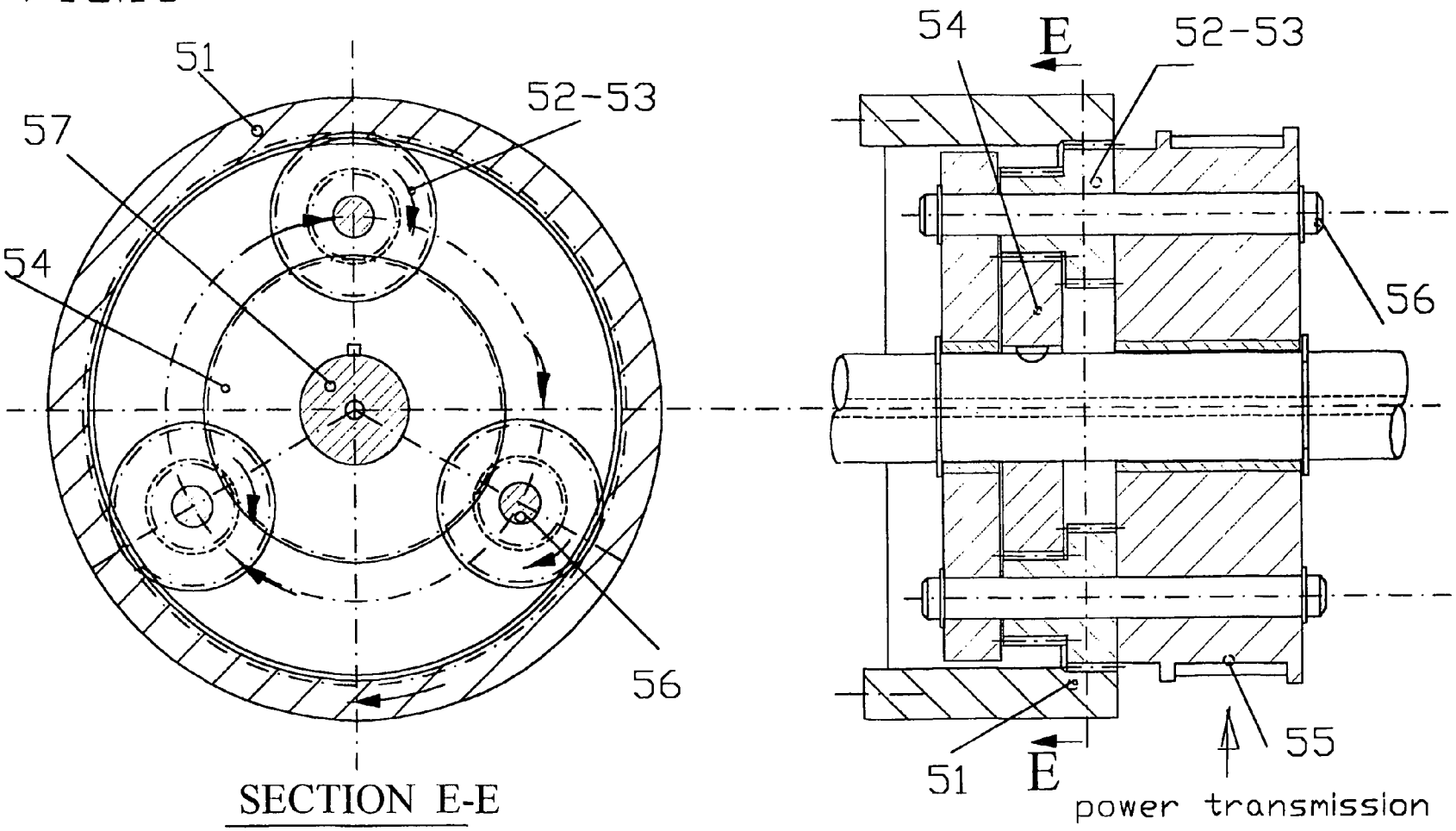

FIG. 13 shows a section (section E—E) through the power transmission elements of the engine, containing a hollow shaft 57, a planetary gear, which again consists of a hollow interior gear 51, which is fully rotating with gear 38, and planetary gears 52,53 with two different, adapted diameters and the corresponding shafts 56, and the sun gears 54. Through the alternating movement of of the gears 51/54, at power wheel 55 an even rotation in the same direction is brought about.

To start the engine, the power wheel 55 must be driven and by means of a magnetic clutch (brake) one hollow shaft must be prevented from moving until the working cycle starts. Optionally, compressed air pressed into disk 3 (compressor) can be used to start the engine.

Figure 1:
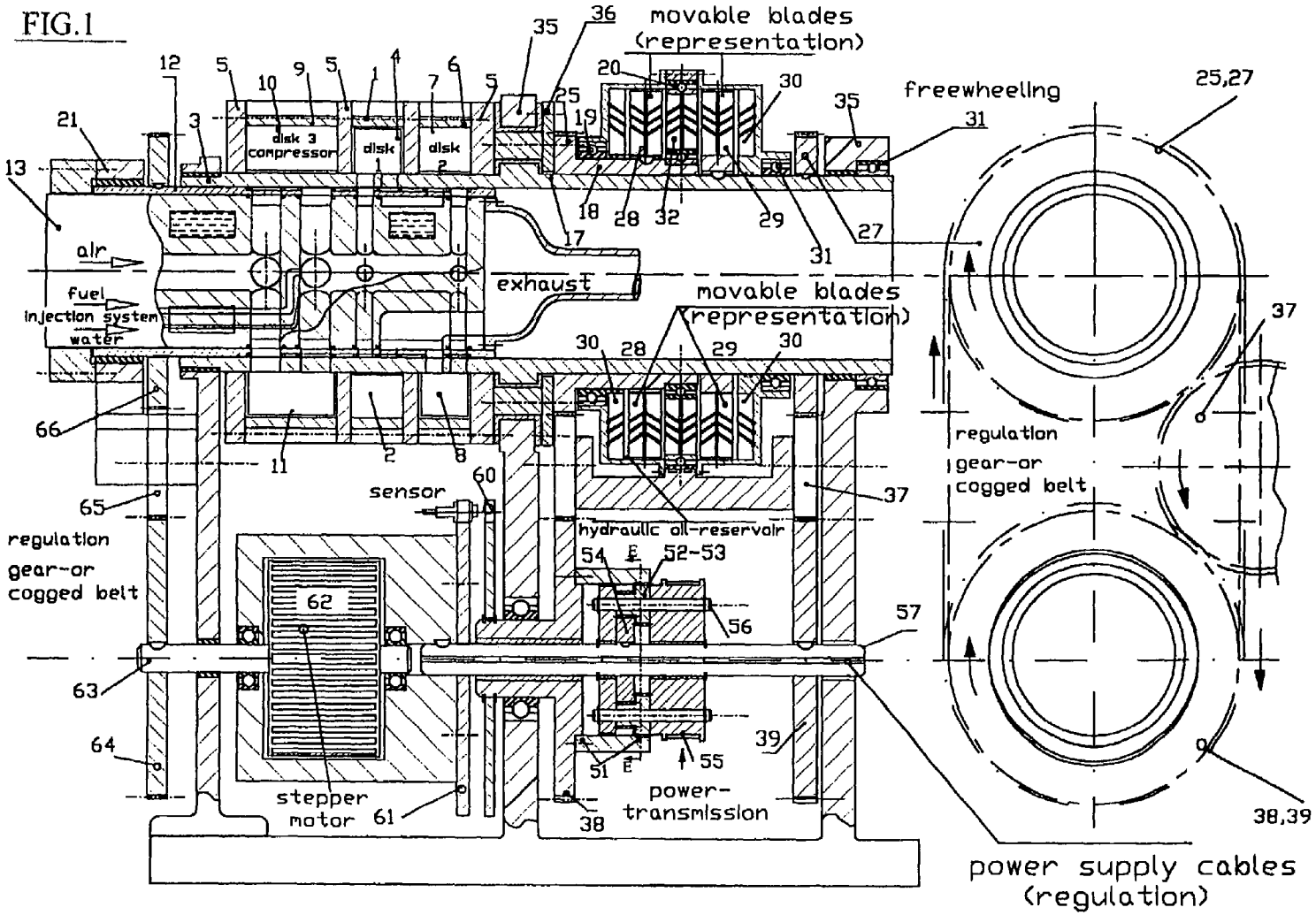

FIG. 1.2 shows as an alternative to FIG. 1 a power-transmission element with a differential gear according to the prior art. Function and method of operation remain similar (FIG. 1.2 to 1).

For the designs as per FIGS. 1.1 and 1.1.1, where an electric generator 58 is driven, the planetary gear or the differential gear can be dispensed with.

The electric generator can also serve as starter, magnetic clutch or magnetic brake of the engine.

Figure 2:
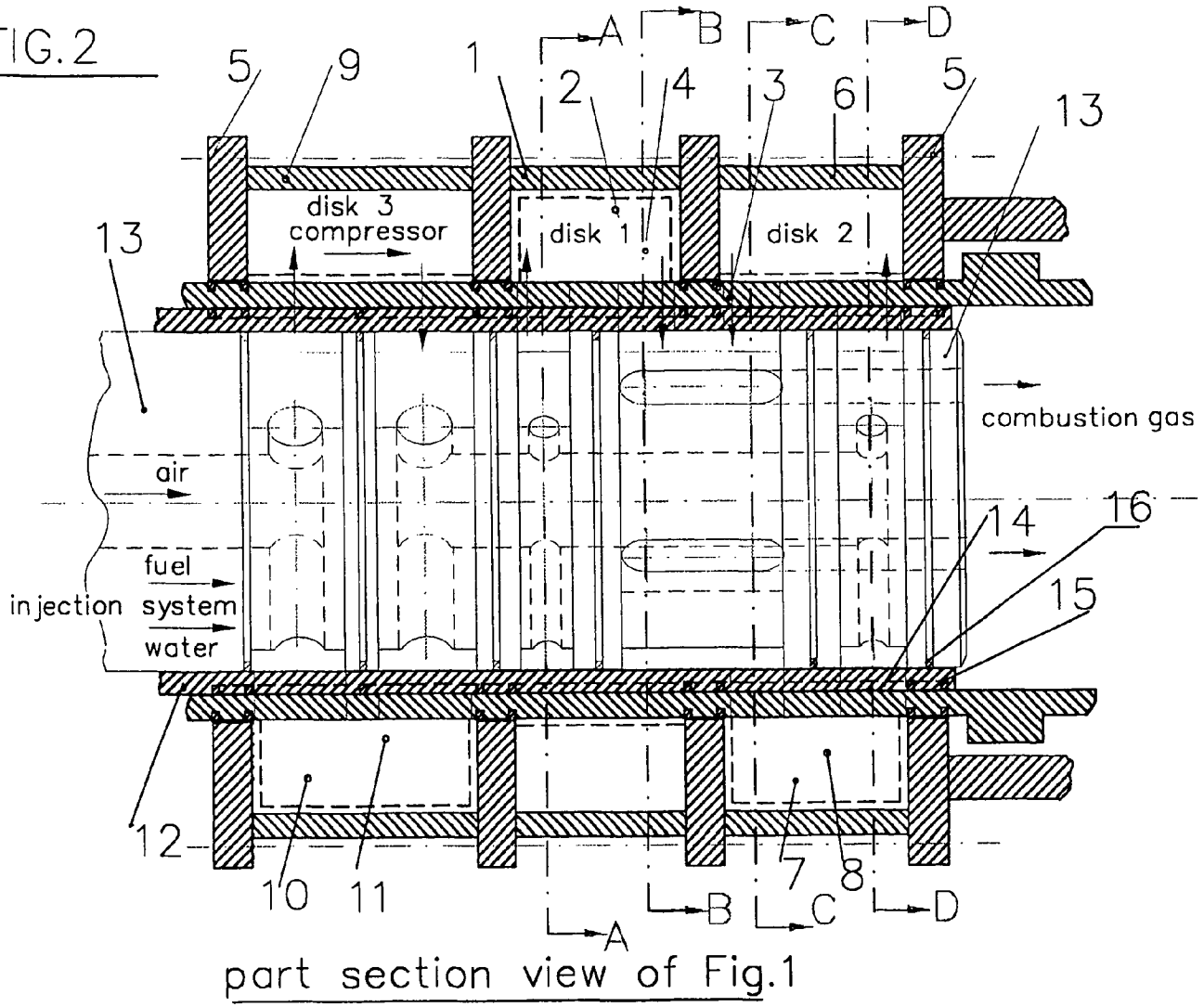

FIG. 2.3 shows an alternative to FIG. 2.1. FIG. 2.2 depicts the intake channel level as shown in section B—B with 2 separate control bushings, one for intake and one for exhaust. As a consequence the openings at both cylinders can be wider and the opening times for inlet and discharge can be controlled independently from each another as desired.

Figure 2A:
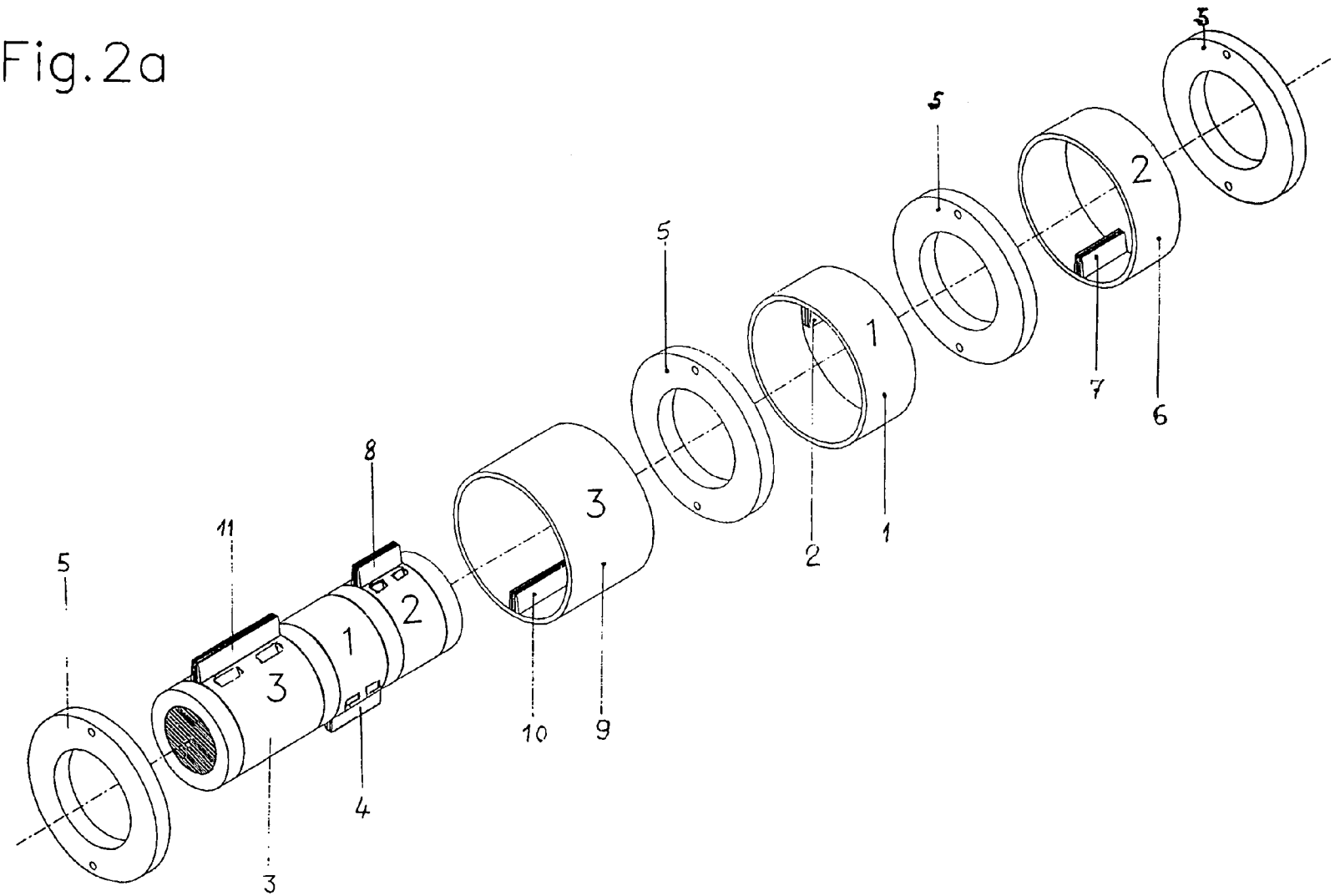
Figures 1, 2A:
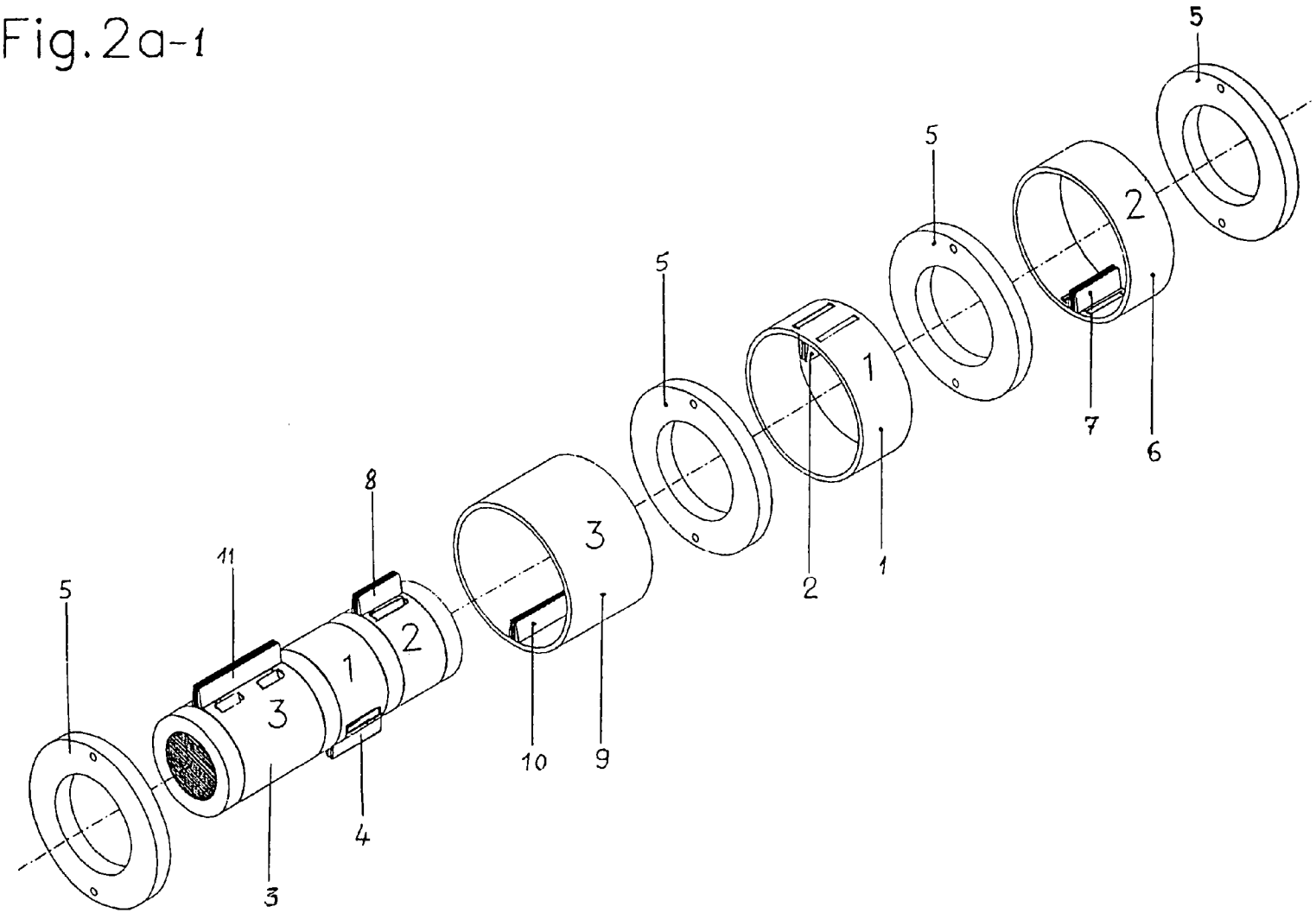
Figure 2B:
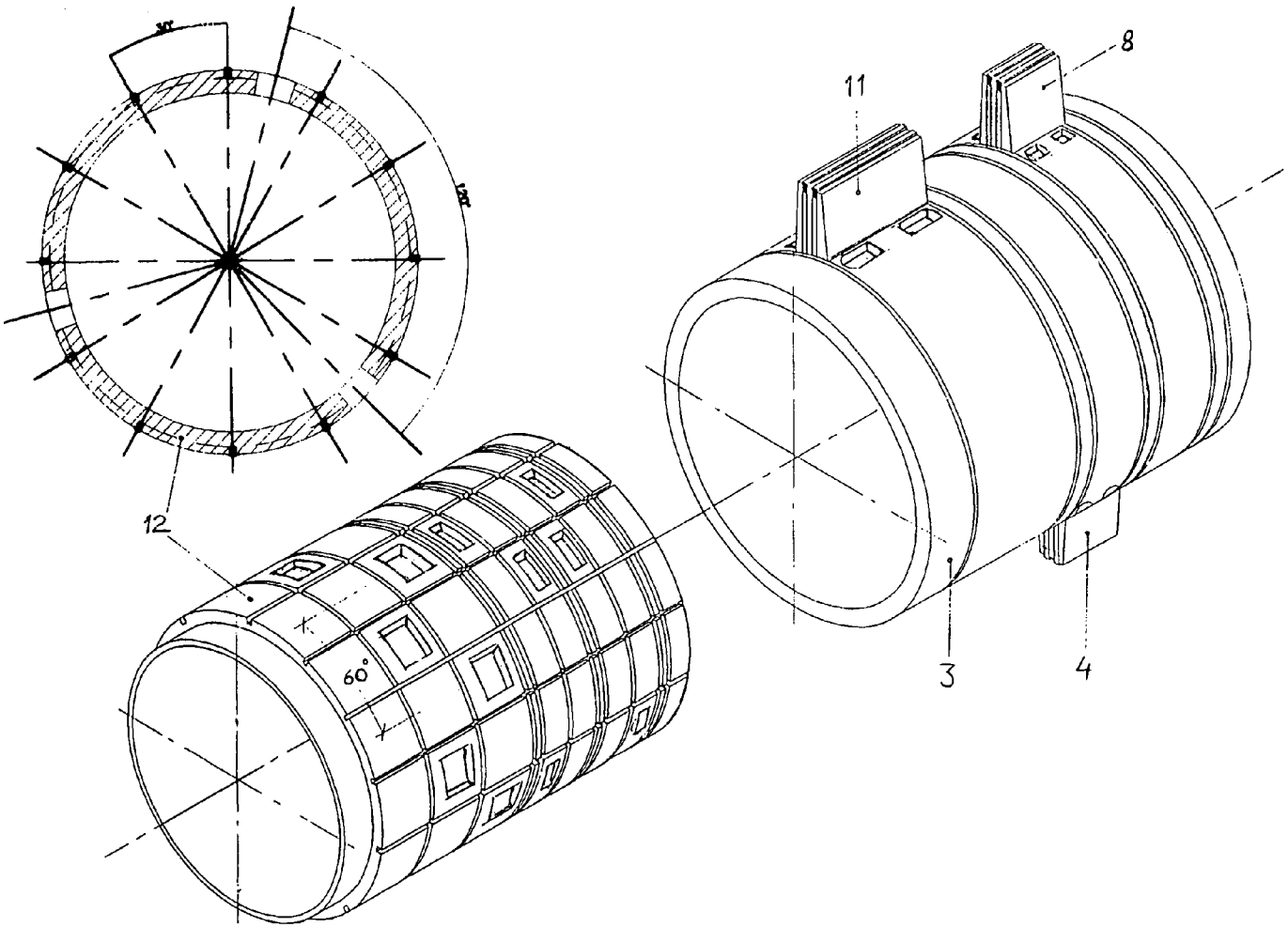
Figures 1, 2B:
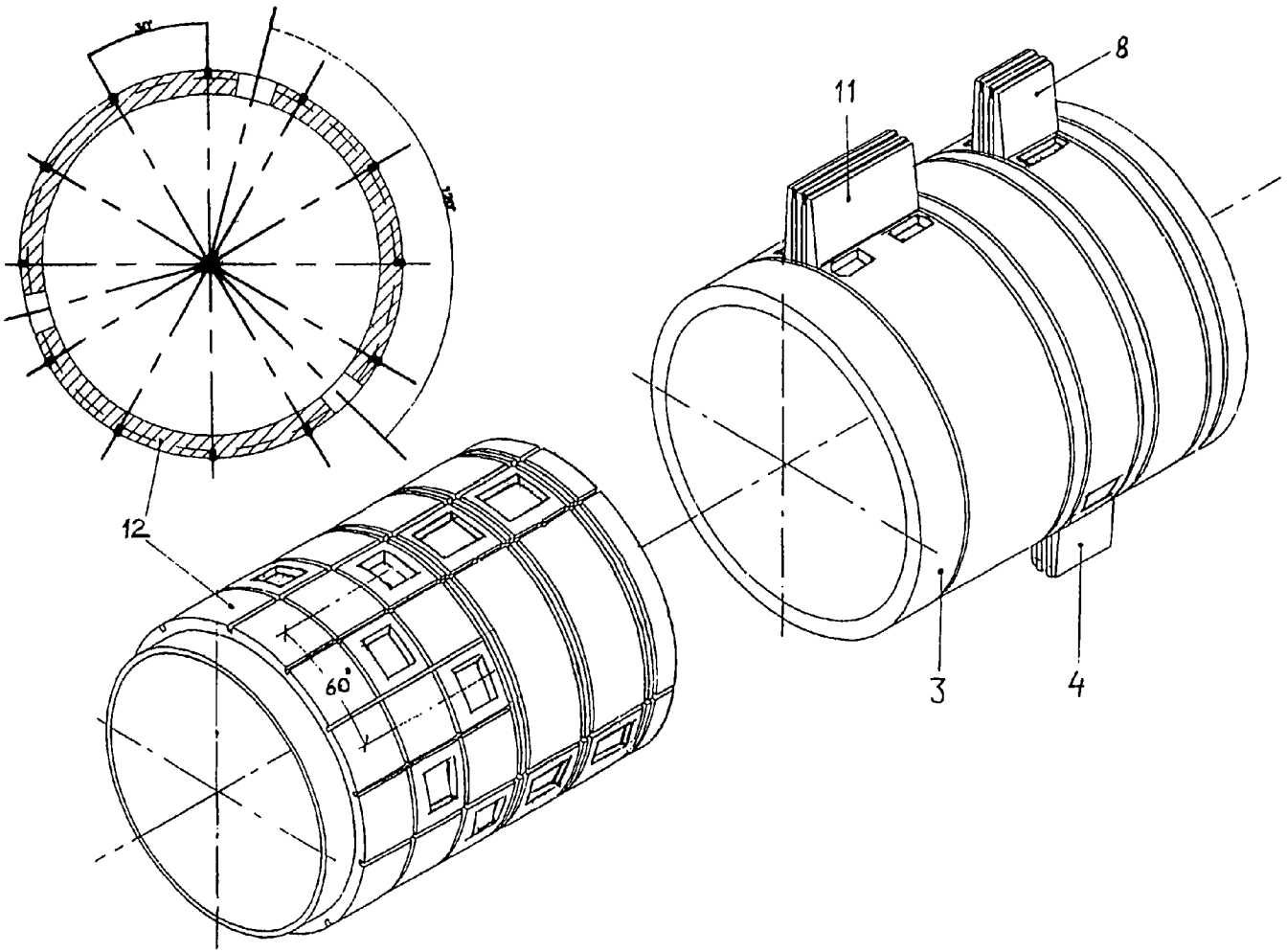
Figure 3:
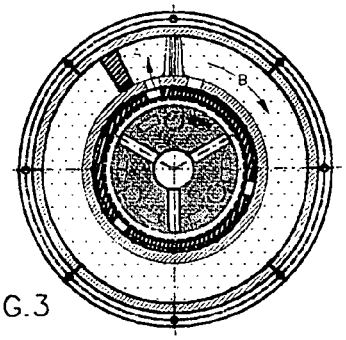
Figure 3A:
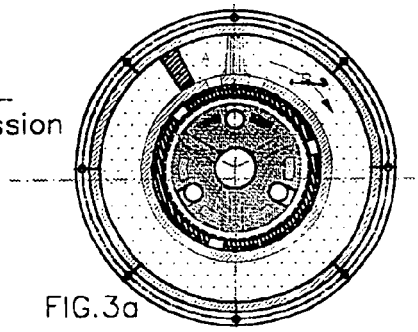
Figure 4:
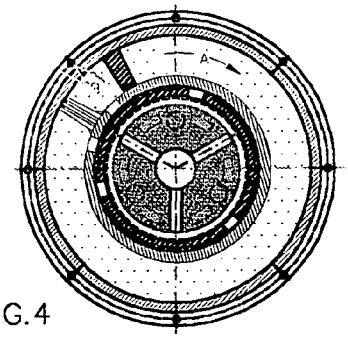
Figure 4A:
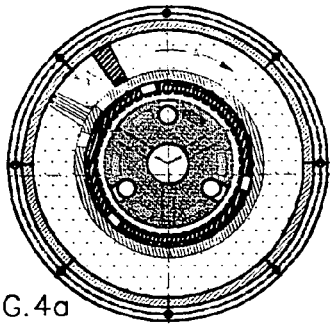
Figure 5:
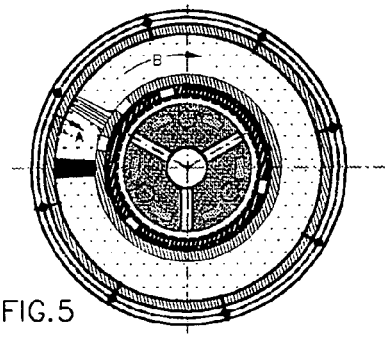
Figure 5A:
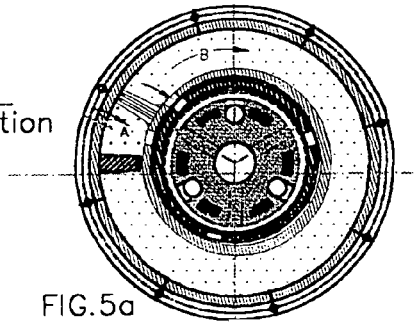
Figure 6:
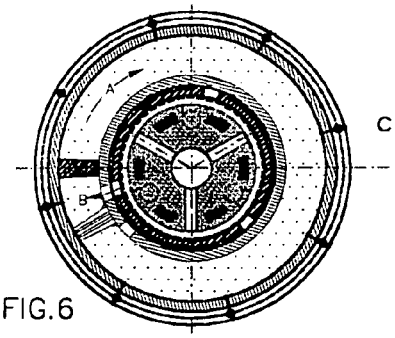
Figure 6A:
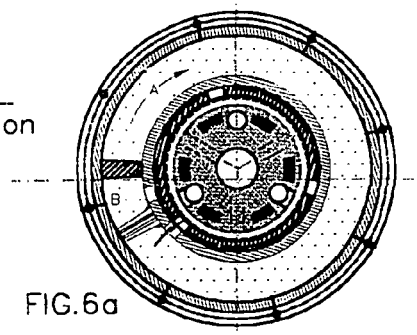
Figure 7:
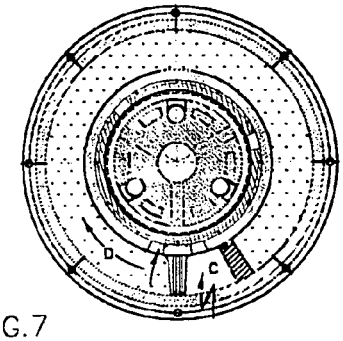
Figure 7A:
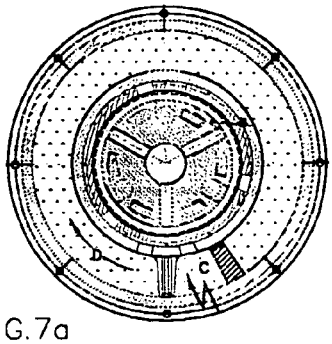
Figure 8:
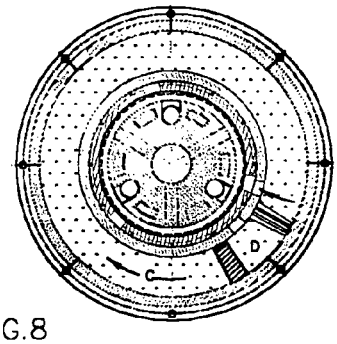
Figure 8A:
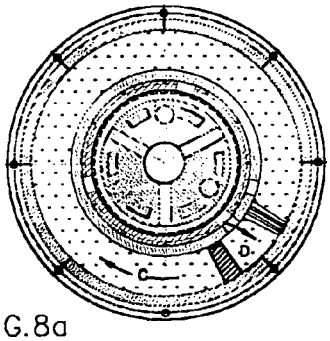
Figure 9:
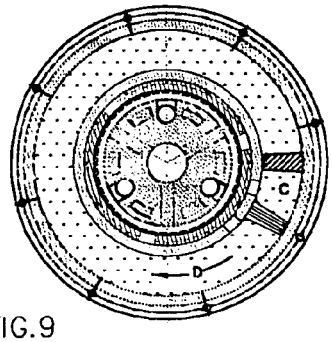
Figure 9A:
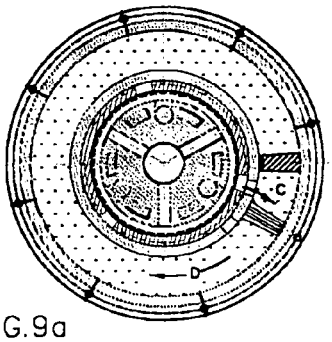
Figure 10:
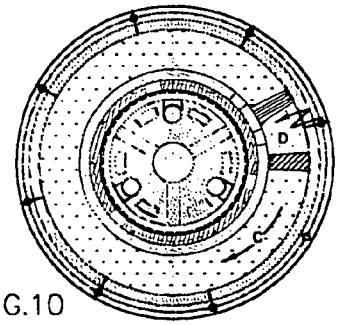
Figure 10A:
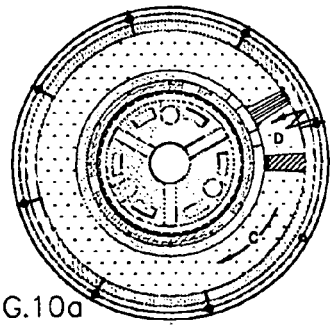
Figure 11:
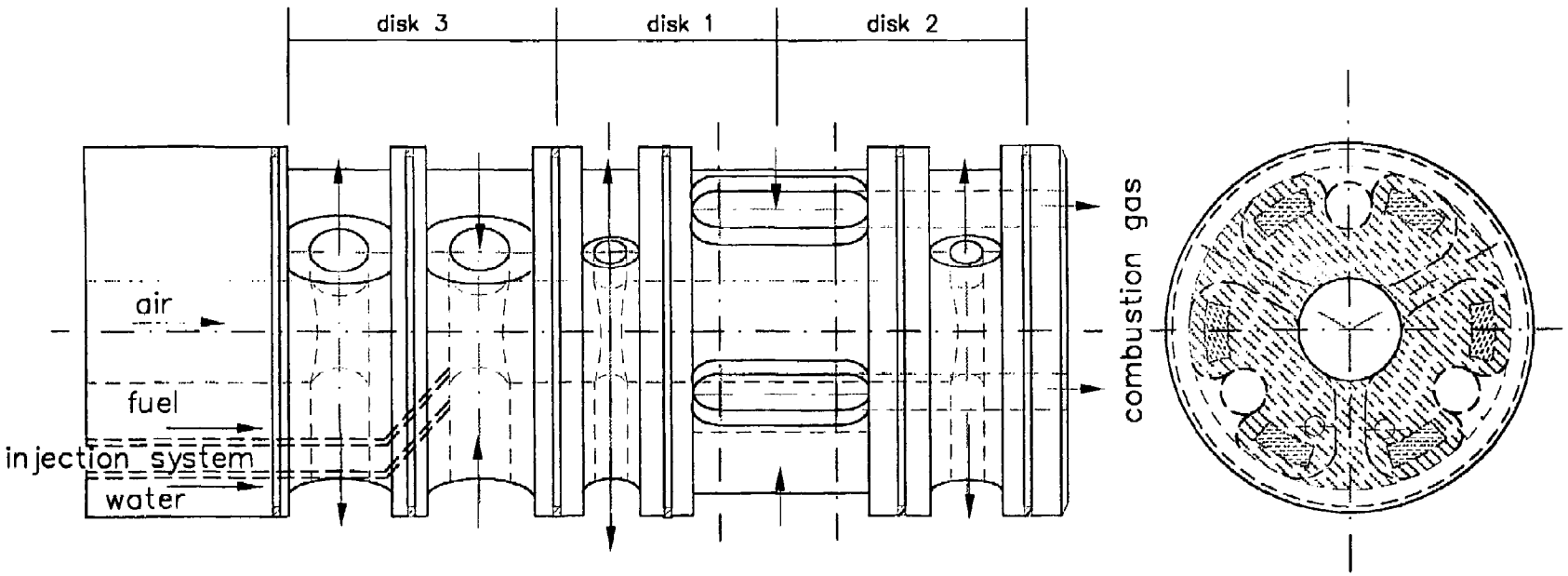
FIG. 11 shows the static cylinder core with intake and exhaust openings, openings for fuel and water supply as well as grooves for seals.
Figure 12:
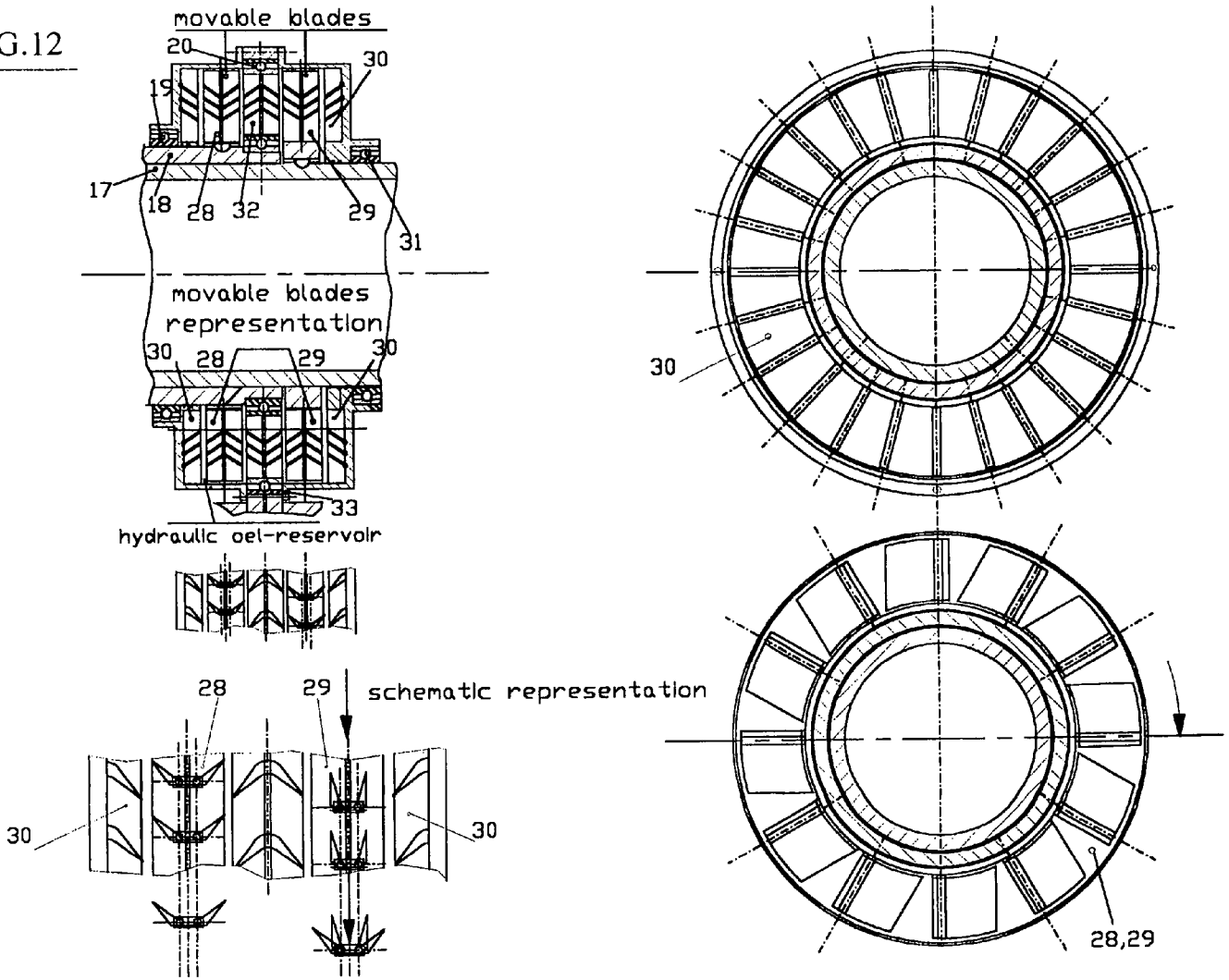
FIG. 12 Shows the retaining system that prevents reversed rotation. It contains two fixed external wheel blades 30 and one double-sided turbine blade wheel 32, pivoted with a bearing in the middle with freewheel permitting only forward rotation.

FIG. 2*a*-1 and FIG. 2*b*-1 shows a modified three-dimensional-perspective in accordance to FIG. 2.3.

In all applications the stepper motor(s) 62 together with the angle encoder and the pulse generator disk (60, 61), which rotate in a 1 to 1 ratio with the transmission (hollow) (interior and exterior) shaft, receives pulses from the pulse generator and the control unit.

PARTS LIST

1: Exterior—cylinder for disk (plate) 1
2: Exterior cylinder—blade for disk (plate) 1
3: Interior cylinder for disks (plates) 1,2,3
4: Interior cylinder—blade for disk (plate) 1
5: Partition walls
6: Exterior—cylinder for disk (plate) 2
7: Exterior cylinder—blade for disk (plate) 2
8: Interior cylinder—blade for disk (plate) 2
9: Exterior—cylinder for disk (plate) 3
10: Exterior cylinder—blade for disk (plate) 3
11: Interior cylinder—blade for disk (plate) 3
12: Control bushing
13: Cylinder core with intake—and exhaust ports
14: Sealing strip—control bushing
15: Radial seal rings—control bushing
16: Radial seal rings—cylinder care
17: Transmission hollow shaft—"interior"
18: Transmission hollow shaft—"exterior"
19: Bearing with freewheeling for transmission hollow shaft—"exterior"
20: Bearing with freewheeling for turbine blade wheel
21: Bearing for 12 and fastening for 13
26: Gear—or cogged belt for transmission hollow shaft—"exterior"
27: Gear—or cogged belt for transmission (hollow) shaft—"interior"
28: Turbine blade with movable blades for transmission hollow shaft—"exterior"
29: Turbine blade with movable blades for transmission (hollow) shaft—"interior"
30: Fixed external (outer) blades
31: Bearing with freewheeling for transmission (hollow) shaft—"interior"
32: Two side turbine blade possibly with bearing and freewheeling
33: Rigid (fixed) housing with hydraulic oil—reservoir and eventl. (possible) pump
35: Plain bearing housing for half bearings—hollow shaft
36: Bearing flange
37: Intermediate gears
38: Gear—or cogged belt for engine drive (output) end and regulation 60
39: Gear—or cogged belt for engine drive (output) end and regulation 61+62
40: Flywheel (balance wheel) for interior—cylinder
51: Internal ring gear
52: Planetary—gear "a" coupled together (combined) with "b"
53: Planetary—gear "b"
54: Sun gear (center, internal gear)
55: Gear—or cogged belt for engine drive (output) end and starting (alternate with differential FIG. 1.2)
56: Planetary—gear shaft
57: Power—transmission shaft with power supply cables for 62
58: Generator (generator+starter)
59: " " brush set
60: Pulse-generator—disk for stepper motor
61: Disk with pulse-generator
62: Stepper motor for control bushing 12
63: Stepper motor-shaft
64: Gear—or cogged belt-wheel for regulation 12
65: Intermediate gear (shaft gear) " " "
66: Gear—or cogged belt " " "

The invention claimed is:

1. In a rotary combustion engine equipped with an interior cylinder and an exterior cylinder, rotatable within each other, each cylinder possessing a blade, rotatable at different speeds about one axis, thus effecting the intake of an air-fuel-mixture, a compression, a working cycle and a discharge of burning gases, and with corresponding intake and exhaust openings for air, apparatus comprising:

a control bushing for controlling the intake and exhaust openings;

a stepper motor for driving the control brushing, the stepper motor including rotating blades controlled (accelerated or decelerated) by freewheeling elements including unilaterally acting hydrodynamic brakes; and the intake and exhaust openings disposed in the control bushing brought to overlap in congruence with the openings of the interior and exterior cylinders by a calculated rotational angle of the stepper motor.

2. The apparatus according to claim 1, wherein the stepper motor is coupled to a hollow shaft, having an interior and exterior, rotates with it with the hollow shaft with a 1 to 1 ratio, and is connected through a brush set-cable-system with a stepper motor control unit, the control unit receiving corresponding signals via an interaction of a disk and an angle encoder, the disk and angle encoder rotating together with the hollow shaft interior and exterior in a 1 to 1 ratio, the control unit, supplied with signals from a signal transmitter (pulse generator), transmitting corresponding pulses to the stepper motor, by transmission to the control bushing, the optimum cycle times (opening times, closing times and opening duration) are determined by rotational speed and load.

3. The apparatus according to claim 1 wherein the intake and exhaust openings of the control bushing are located along the circumference, with the intake openings spaced 60° apart and the exhaust openings offset by 30°.

4. The apparatus according to claim 1 wherein the interior cylinder has two openings at each side of the blade of each disk the openings being spaced apart by one cycle.

5. The apparatus according to claim 1 wherein the blades rotate about one axis independently of each other at different velocities, and all four strokes of the engine take place at any location and with any stroke length.

6. The apparatus according to claim 1 further comprising a cylinder core equipped with corresponding ring-shaped channels, each channel having sealing rings secured against rotation and sealed tight towards neighboring chambers, each channel having openings for air intake, discharge, and fuel supply.

7. The apparatus according to claim 1 further comprises two working chambers per disk for dispensing with empty strokes in order to minimize power loss, thereby leading to maximum efficiency.

8. The apparatus according to claim 1 further comprising a prechamber (inlet channel) for enabling injection of heated cooling water in order to generate additional energy.

9. The apparatus according to claim 1 further comprising a second control bushing and a second stepper motor for independently controlling the intake openings and the exhaust openings.

10. The apparatus according to claim 1 wherein the freewheeling element comprises two fixed external blades and one double-sided turbine blade wheel pivoted in their middle thereof in order to safeguard the inner and outer cylinder against rotation in a wrong direction the two double-sided turbine blade wheels have movable blades rotatable with the hollow shafts in an oil (fluid), during forward rotation of a respective turbine blade wheel in the fluid the blades shut and at the same time the blades of the other turbine blade wheel open through the fluid flow and decelerate the wheel and accelerate the counterpart wheel by the working stroke.

11. The apparatus according to claim 1 further comprising two flywheels for balancing mass differences between blades.

12. The appartaus according to claim 1 further comprising at least one of a power transmission gear and a generator in an operative relationship with the engine, the generator being operative for starting the engine.

* * * * *

UNITED STATES PATENT AND TRADEMARK OFFICE

CERTIFICATE OF CORRECTION

PATENT NO. : 7,156,068 B2
APPLICATION NO. : 10/514147
DATED : January 2, 2007
INVENTOR(S) : Galip Yüksel It is certified that error appears in the above-identified patent and that said Letters Patent is hereby corrected as shown below:

In column 6, lines 35-38:

"a stepper motor for driving the control brushing, the stepper motor including rotating blades controlled (accelerated or decelerated) by freewheeling elements including unilaterally acting hydrodynamic brakes; and"

Should read:

"a stepper motor for driving the control bushing wherein the blades are controlled (accelerated or decelerated) by freewheeling elements including unilaterally acting hydrodynamic brakes; and"

Signed and Sealed this

Twenty-seventh Day of July, 2010

David J. Kappos

David J. Kappos
*Director of the United States Patent and Trademark Office*